United States Patent [19]

Kokes

[11] 4,361,326

[45] Nov. 30, 1982

[54] GOLF CLUB GRIP PAD

[76] Inventor: Ivan J. Kokes, Valley View Dr., Waverly, N.Y. 14892

[21] Appl. No.: 120,703

[22] Filed: Feb. 11, 1980

[51] Int. Cl.[3] ..... A63B 53/14

[52] U.S. Cl. ..... 273/81 D; 273/165; 273/186 A

[58] Field of Search ..... 273/72 R, 72 J, 75, 273/81 R, 81 B, 81 D, 165, 166, 183 D, 183 B, 81.4, 81.6, 77 R, 186 R, 186 A

[56] References Cited

U.S. PATENT DOCUMENTS

| | | | |
|---|---|---|---|
| 1,664,257 | 3/1928 | McCullough | 273/81.4 |
| 1,690,312 | 11/1928 | Rosan | 273/165 |
| 1,997,364 | 4/1935 | Holden et al. | 273/165 |
| 2,484,762 | 10/1949 | Strazza | 273/165 |
| 2,628,100 | 2/1953 | Beebe | 273/81.4 |
| 2,984,486 | 5/1961 | Jones | 273/75 X |
| 3,227,455 | 1/1966 | Hulsman | 273/165 |
| 3,256,023 | 6/1966 | Frazelle | 273/165 |
| 3,311,375 | 3/1967 | Onions | 273/75 X |
| 3,500,572 | 3/1970 | Johnson | 273/75 X |
| 3,606,326 | 9/1971 | Sparks et al. | 273/81 R |
| 3,806,130 | 4/1974 | Jacques | 273/165 X |
| 3,860,243 | 1/1975 | Prisco | 273/165 |
| 4,252,319 | 2/1981 | Lorang | 273/165 X |

*Primary Examiner*—Richard J. Apley
*Attorney, Agent, or Firm*—George E. Clark

[57] ABSTRACT

A pad of closed cell foam rubber material or the like is fixed to a golf club grip in a position to be held by the lower hand. The pad is adapted to absorb energy from the lower hand during a golf swing to prevent overpowering of the club by the lower hand. The pad includes a layer of closed cell foam rubber and a pressure sensitive adhesive to afix the pad to the golf club grip.

3 Claims, 6 Drawing Figures

GOLF CLUB GRIP PAD

BACKGROUND OF THE INVENTION

The present invention relates to a gripping attachment for a golf club and more particularly to a gripping attachment adapted to absorb energy from the lower hand during a golf swing.

In the prior art, there are various gripping attachments to be used with golf clubs. One example is a swivel grip made of a plastic material as shown in U.S. Pat. No. 3,095,198. This swivel grip is adapted to be used by the lower hand on the grip to reduce hooking and slicing.

Another prior art golf club gripping device is shown in U.S. Pat. No. 1,690,312. This patent shows a deformable grip made of celluloid or similar material which is designed to maintain the fingers of the lower hand in the proper position to improve the golf club swing.

Another prior art device is that shown in U.S. Pat. No. 3,837,647 which is a golf club grip formed of a tubular sleeve of circular cross-section with the grip being formed in an elongated, truncated conical shape whose larger base is at the sleeve end closest to the club head and whose smaller base is adjacent the free end of the shank, so that the outer surface of the grip is gradually tapered along a straight line taper with the grip smaller diameter end terminating in an integral, enlarged diameter knob-like portion. Basically, the grip of this patent is similar to a baseball bat with the upper hand at a narrower portion of the handle and the lower hand at a larger diameter portion of the handle. Again as before, the objective of the grip is to improve the golf swing.

Another prior art golf club grip is shown in U.S. Pat. No. 3,806,130. The patent shows a split sleeve gripping aid for teaching the proper swing and to avoid the golfer gripping the club to tightly with the lower hand. The sleeve has a longitudinal slit to permit easy installation and removal from the golf club. The sleeve of the patent is not a permanent attachment to the golf club, but is merely used as a training aid. The sleeve fits loosely on the club handle and is held in proper orientation by the thumb of the upper hand.

SUMMARY OF THE INVENTION

It is an object of the present invention to provide a golf club grip of energy absorbing resilient material which is adapted to be affixed to the golf club at a location along the handle for gripping with the lower hand to prevent overpowering of the club by the lower hand.

It is another object of the present invention to provide a grip as above wherein the grip is constructed of a closed cell foam rubber material or the like for absorbing energy from the golfer's lower hand and wherein the grip has a pressure sensitive adhesive backing for permanently affixing the grip to the golf club.

It is yet another object of the present invention to provide a golf club grip as above having a notch to accept the thumb of the golfer's upper hand.

Yet another object of the present invention is to provide a mirror image golf club grip as above for left handed golfers.

According, a golf club grip constructed of any one of several degrees of density of close cell foam rubber material or the like having a pressure sensitive adhesive backing is placed on a golf club at a position convenient to the grip of a golfer's lower hand and affixed thereto with the pressure sensitive adhesive backing. The grip may be constructed in embodiments for right handed or left handed golfers. In either case a recess or knotch is provided to accept the thumb of the golfer's upper hand.

It is advantage of the present invention that the closed cell resilient material used in the grip according to the present invention will absorb energy from his lower hand preventing overpowering of the club by the lower hand to improve the golf swing.

These and other objects of the present invention will become immediately apparent from the following detailed description in conjunction with the accompanying drawing.

DETAILED DESCRIPTION OF PREFERRED EMBODIMENT OF THE INVENTION

Figure 1:
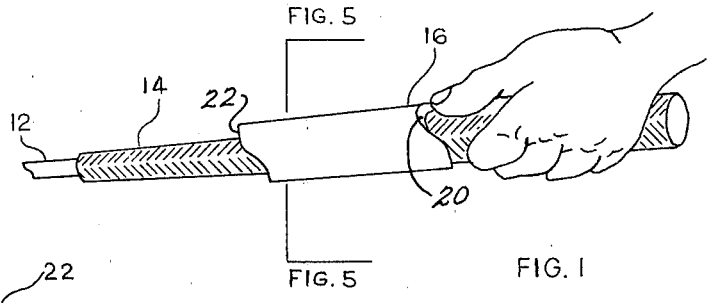
FIG. 1 is a perspective view of a section of a golf club including a gripping attachment according to the present invention.

Referring now to FIG. 1, a preferred embodiment of the present invention will be described.

Golf club shaft 12 includes handle 14 covering the upper portion of the shaft 12. A gripping attachment 16 according to the present invention is placed at a location along handle 14 convenient to the grip of the golfer's lower hand.

Figure 2A:
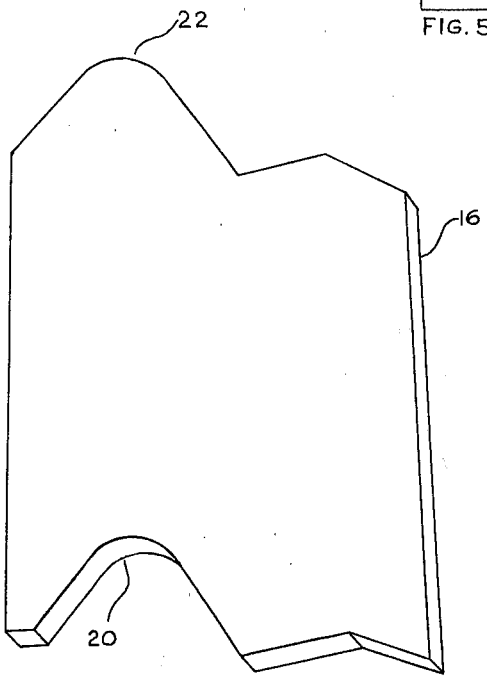
FIG. 2A is a top view of a gripping attachment according to the present invention for right handed golfers.
Figure 2B:
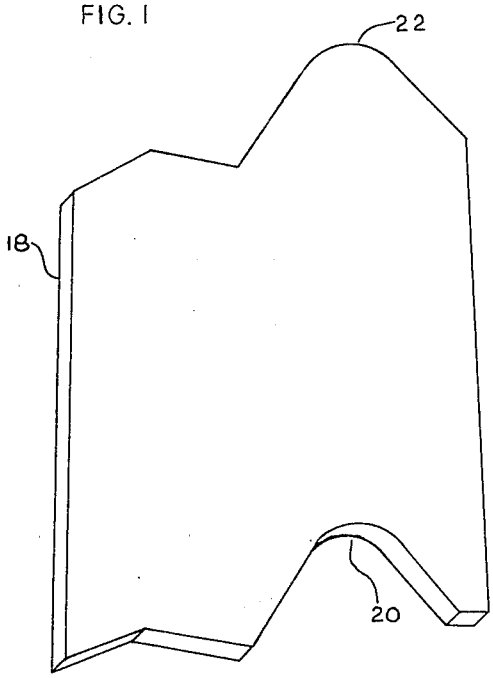
FIG. 2B is a top view of a gripping attachment according to the present invention for left handed golfers.
Figure 3:
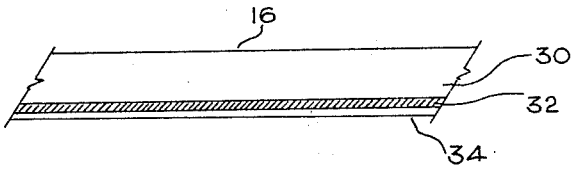
FIG. 3 is a cross-section view of a gripping attachment according to the present invention.

Referring now to FIGS. 2A, 2B and 3, the gripping attachment 16 according to the present invention will be described. Gripping attachment 16 for right handed golfers includes a notch 20 for receiving the golfer's left thumb and a portion 22 for providing a comfortable grip by the golfer's lower hand. In FIG. 2B, gripping attachment 18 for left handed golfers is fundamentally the same as the structure of gripping attachment 16 for right handed golfers with the exception of the mirror image construction which provides that the seam of the gripping attachment is located away from the golfer's palm of hand.

The cross-section of the gripping attachment 16 as shown in FIG. 3 includes a thickness of closed cell resilient material such as foam rubber or the like which may be selected from several degrees of density depending upon the strength and experience of the golfer, the resilient material 30 having a pressure sensitive adhesive backing 32 for attaching the gripping attachment 16 to the handle 14 of golf club shaft 12. A tear-off paper backing 34 is included with the gripping attachment 16 but is removed before application to the handle 14 of golf club 10.

Figure 4:
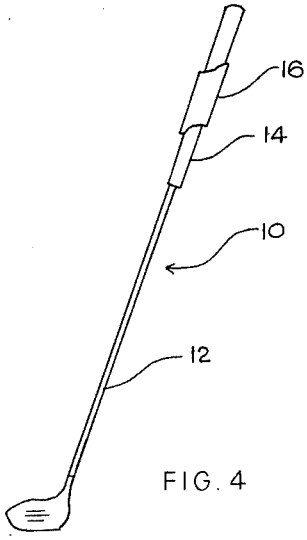
FIG. 4 is a perspective view of a golf club including a gripping attachment according to the present invention.
Figure 5:
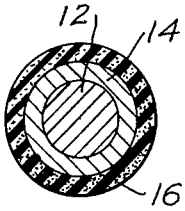
FIG. 5 is a cross-section view of a golf club handle including a gripping attachment according to the present invention.

FIGS. 4 and 5 show the placement of the gripping attachment on a golf club 10 and further in FIG. 5 the cross-section of the golf club shaft 12 is shown including the shaft 12 at the center, the original golf club handle 14 surrounding the shaft 12 and the gripping attachment 16 surrounding handle 14 of the golf club 10.

The gripping attachment 16 shown in FIGS. 1 thru 5 is applied to the handle 14 of golf club 10 in the following manner. The golfer grips the club handle 14 with the upper hand in a comfortable position and properly aligns the club. The lower hand is then placed in the normal gripping position and the position is noted. Then, after paper backing 34 has been removed from pressure sensitive adhesive 32, gripping attachment 16 is applied to handle 14 of the golf club such that the thumb of the golfer's upper hand is aligned with notch 20 to properly align the gripping attachment 16 to the golfer's customary grip of a golf club 10. The pressure sensitive adhesive backing 32 permits the gripping attachment 16 to be properly attached to the handle 14 such that the gripping attachment will not rotate during the golf swing.

Although a preferred embodiment of the invention has been described, it will be apparent to those skilled in the art that there are many variations and modifications which may be made without departing from the spirit or scope of the invention. Therefore, the invention is not to be limited by the specific disclosure of a preferred embodiment herein, but only by the appended claims.

What is claimed is:

1. A golf club gripping attachment for improving a golf swing, comprising:

a pad of closed cell energy absorbing resilient material, the density of said closed cell energy absorbing resilient material being selected for a predetermined amount of energy to be absorbed from a golfer's lower hand during a golf swing, said pad being of substantially uniform thickness without any protuberances or depressions, said paid further comprising an upper edge having cut out portion, said cut out portion being longitudinally oriented within the plane of the thickness of said pad, said cut out portion being adapted to align said pad with a thumb on said golfer's upper hand, said pad being sized and positioned on said golf club to accept only said golfer's lower hand, the transverse dimension of said pad being sized to encircle the handle of a golf club, said pad further comprising an adhesive backing for attaching said pad to a handle of (said) a golf club in a position determined by said golfer to avoid rotation of said pad relative to said handle and said golfer's upper hand.

2. A golf club gripping attachment according to claim 1 wherein said cut out portion is positioned on said upper edge of said pad to align said pad with a thumb of a right handed golfer.

3. A golf club gripping attachment according to claim 1 wherein said cut out portion is positioned on said upper edge of said pad to align said pad with a thumb of a left handed golfer.

* * * * *